United States Patent [19]

Böser et al.

[11] Patent Number: 5,010,750

[45] Date of Patent: Apr. 30, 1991

[54] LOCK CYLINDER WITH ELECTROMAGNETIC TUMBLER

[75] Inventors: Werner Böser, Zulpich; Giselher Sieg, Erftstadt; Robert Wedekind, Erftstadt-Erp, all of Fed. Rep. of Germany

[73] Assignee: Dom-Sicherheitstechnik GmbH & Co. KG, Fed. Rep. of Germany

[21] Appl. No.: 473,009

[22] Filed: Jan. 31, 1990

[30] Foreign Application Priority Data

Feb. 2, 1989 [DE] Fed. Rep. of Germany ..... 3902992

[51] Int. Cl.[5] ..... E05B 47/06

[52] U.S. Cl. ..... 70/276; 70/278; 70/283

[58] Field of Search ..... 70/276–283; 292/359

[56] References Cited

U.S. PATENT DOCUMENTS

| | | | |
|---|---|---|---|
| 2,802,357 | 8/1957 | Smith | 70/283 |
| 3,763,676 | 10/1973 | Schachter et al. | 70/276 X |
| 3,782,147 | 1/1974 | Hallmann | 70/276 |
| 3,942,345 | 3/1976 | Sasahara | 70/276 |
| 4,712,398 | 12/1987 | Clarkson et al. | 70/283 X |
| 4,736,970 | 4/1988 | McGourty et al. | 70/283 X |
| 4,807,454 | 2/1989 | Sengupta et al. | 70/386 X |

*Primary Examiner*—Lloyd A. Gall

*Attorney, Agent, or Firm*—Barry E. Deutsch; J. Bruce Hoofnagle

[57] ABSTRACT

A lock cylinder suitable for mortise locks comprises mechanically operating tumbler pins controlled by a key and at least one electromagnetic tumbler. The cylinder is arranged in a cylinder casing and comprises a coil as well as a locking member which can be displaced by electromagnetic forces for an additional tumbler pin which is spring-loaded in the locking direction and with a reading device which detects a key code. The locking member is pivotally mounted in a recess in the additional tumbler pin and enters the locking position in front of a stop on the cylinder casing.

15 Claims, 5 Drawing Sheets

FIG.5
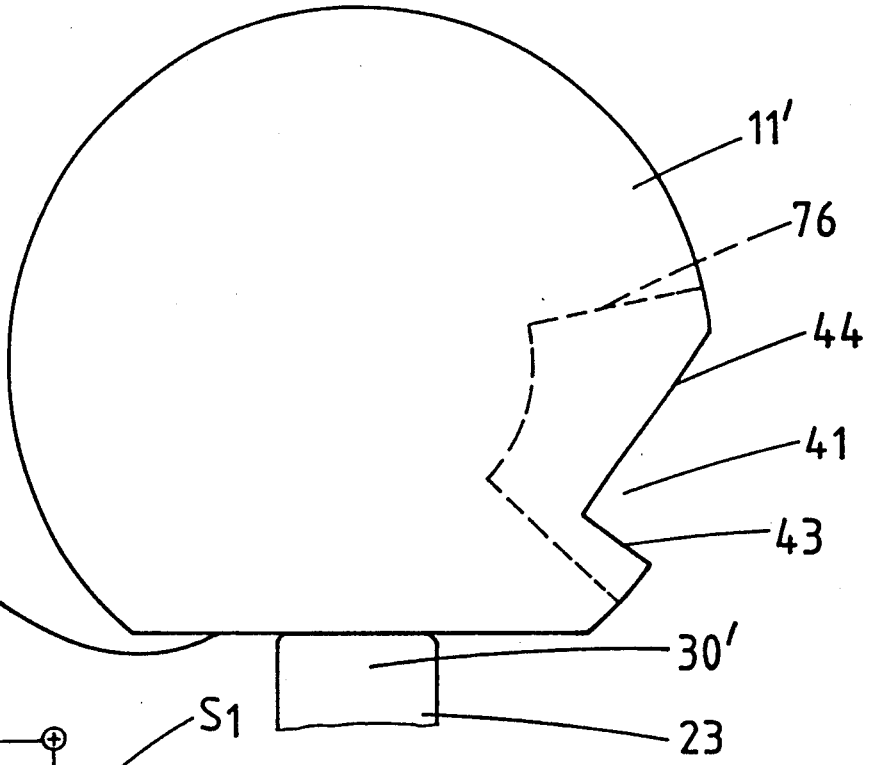
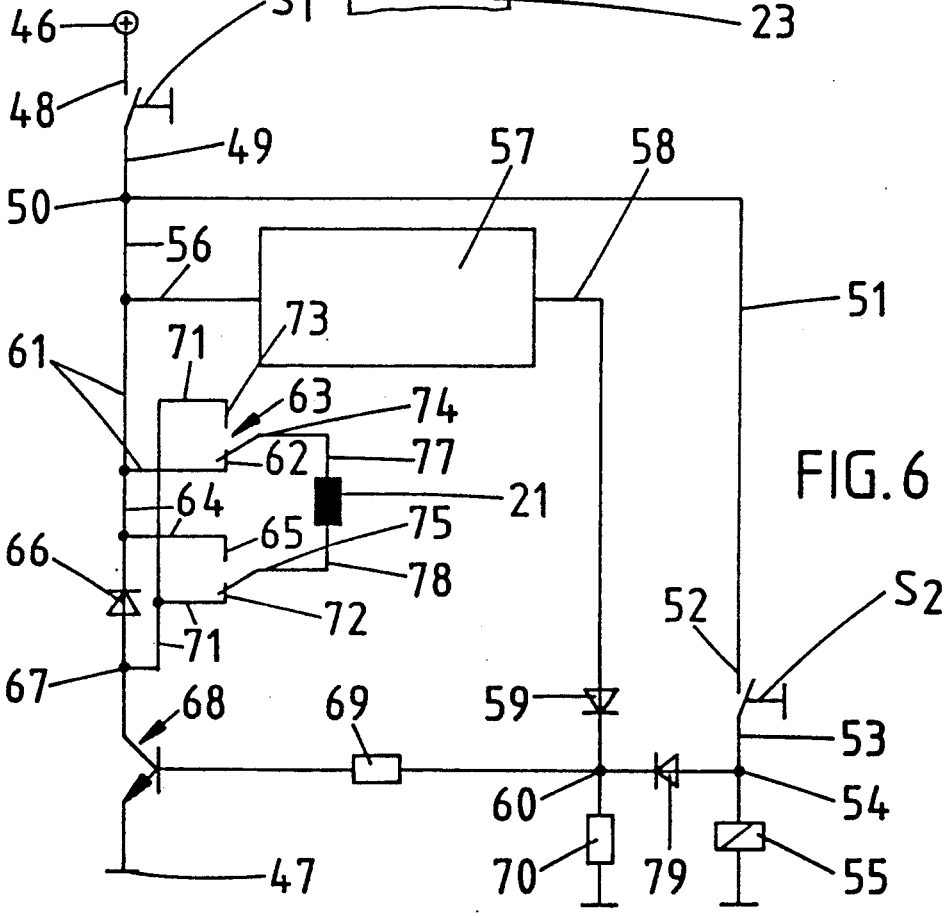
FIG.6

LOCK CYLINDER WITH ELECTROMAGNETIC TUMBLER

BACKGROUND OF THE INVENTION

The invention relates to a lock cylinder, in particular for mortise locks with mechanically operating tumbler pins controlled by the key and at least one electromagnetic tumbler which is arranged in the cylinder casing and comprises a coil as well as a locking member, which can be moved by electromagnetic forces, for an additional tumbler pin spring-loaded in the locking direction and with a reading device detecting a key code.

A lock cylinder of this type is known from European Patent Application 0 281 507, the tumbler pin spring-loaded in the engagement direction engaging with its conical head into a half dish in the cylinder core. The end of the tumbler pin opposite the head co-operates with spreading spheres which are located in casing bores and are in turn surrounded by a tubular locking member. This tubular locking member is provided with an armature which is coaxially orientated relative to the tumbler pin and sinks against spring loading into a coil. If an incorrectly coded key is inserted into the lock cylinder, this is registered by the reading device and the coil connects to the electric circuit, so that the locking member is displaced relative to the tumbler pin and the spheres and removes their freedom of radial movement. Closing rotation is therefore checked as the tumbler pin cannot escape. In addition to the disadvantage that the lock contains a large number of parts, the design cannot withstand high loads. Furthermore, the locking member always has to move against spring loading, requiring greater energy which has proven to be disadvantageous, particularly when the electromagnetic tumbler is powered by a battery.

It is an object of the present invention to provide a lock cylinder of this type in which the electromagnetic tumbler produces locking which can withstand high loading locking while having a compact construction and using minimal electrical power for control thereof.

BRIEF SUMMARY OF THE INVENTION

This object is achieved with a lock cylinder of this type in which the locking member is pivotally mounted in a recess in the additional tumbler pin and, in the locking position, passes in front of a stop on the cylinder casing.

A more secure, lock cylinder of this type is produced by this design. Additional space inside the lock cylinder is not required for arranging the locking member. Instead, the locking member rests in the recess in the additional tumbler pin which can be sturdy in construction and consequently can also tolerate high forces without damage. When the key is introduced into the lock cylinder, the lock cylinder arranges the mechanically operating tumbler pins. The locking member is pivoted into such a position that it passes in front of a stop on the cylinder casing. If the key code is identified as correct by the reading device of the lock cylinder, then the locking member pivots back into its starting position and allows subsequent actuation of the lock. If the key code is absent or if it is identified as incorrect, the locking member remains in its locking position in front of the stop on the cylinder casing despite the correct arrangement of the mechanically controlled tumbler pins and effectively prevents the tumbler pin from escaping. Corresponding closing forces are then conveyed directly into the cylinder casing by the strongly constructed tumbler pin. The sensitive parts of the electromagnetic tumbler are therefore not loaded. As it is the function of the coil merely to produce rotation of the locking member, and spring forces do not have to be overcome, only a very small amount of electric power is used for control purposes, and this is important, particularly when batteries are used to power the electromagnetic tumbler.

In a preferred embodiment of the cylinder according to the invention, the locking member projects in the locking position with a locking edge over the periphery of the additional tumbler pin. Consequently, only a small pivot angle is required and this means that the locking member passes with its locking edge over the periphery in order to co-operate with the stop on the cylinder casing.

To simplify production, the stop is formed by the wall of a niche originating from the pin bore accommodating the additional tumbler pin. On the one hand, this produces the escape space during pivoting of the locking member and, on the other hand, it forms, with its wall, the stop for the locking member.

Additional production advantages derive from the fact that the locking member is held by a pivot pin running transverse to the longitudinal axis of the tumbler pin.

The locking member receives precisely defined end positions since it comprises a permanent magnet. As soon as current stops flowing through the coil, the locking member has a great tendency to return into its starting position.

According to an embodiment of the invention, it is advantageous that the magnet poles allocated to the permanent magnet taper toward their free ends. This causes marked concentration of the magnetic field lines accompanied by a greater restoring force acting on the locking member.

Technical advantages arise in that ferromagnetic core pieces arranged in the tumbler pin face the magnet poles to produce the neutral position of the locking member. As soon as current stops flowing through the coil, the locking member returns to its neutral position or its starting position, as directed, so that lock disturbances are substantially avoided.

An adjustment can be made in that at least one of the core pieces is constructed so as to be axially movable, preferably as a screw.

The fact that the locking edge is formed by the transverse flank pointing in the return direction of the tumbler pin contributes to the simplicity of the configuration. Rod material cut to the appropriate length can therefore be used as starting material for producing the locking member. The appropriate transverse flank is produced in the process.

According to an embodiment of the invention, measures can be taken to prevent the locking behaviour of the tumbler pin in certain rotational positions of the cylinder core in that the side of the locking member opposite the locking edge has an arresting edge which, in the arresting position of the additional tumbler pin, passes against a step on the cylinder casing in such a way that the locking action between cylinder core and tumbler pin is removed. This arresting edge comes into effect only when the tumbler pin has moved a certain distance against the direction of the cylinder core, that is to say in a position in which the arresting edge can pass against the step on the cylinder casing.

A further advantageous feature resides in the provision of a first sensor which detects the inserted position of the key. This sensor causes the coil to be supplied with current and thus to be polarised in such a way that the locking member enters its locking position.

A further advantage is that the tumbler pin sinks with its head region into a locking indentation of the cylinder core in the key withdrawal position. If a convergent head region is selected, the tumbler pin escapes as rotation of the cylinder core commences.

Constructional advantages are also achieved in that the imaginary straight connecting line between the magnet poles of the locking member points in the direction of the longitudinal axis of the tumbler pin in the neutral position of the locking member.

The fact that the coil is provided with a C-shaped armature, between the pole faces of which the locking member lies, also contributes to the compactness of the construction. The armature with coil can consequently be integrated compactly into the overall construction of the lock cylinder without reducing the size of the tumbler pin.

Finally, in a further advantageous feature, the straight connecting line between the armature poles intersects the connecting straight line between the magnet poles. These so-called straight lines appear to intersect at right angles in the neutral position of the locking member.

BRIEF DESCRIPTION OF THE DRAWINGS

An embodiment of the invention is described below with reference to the accompanying drawings, in which:

FIG. 5 is a variation of the locking pin control means; and,

FIG. 6 shows the corresponding circuit diagram.

DETAILED DESCRIPTION

Figure 1:
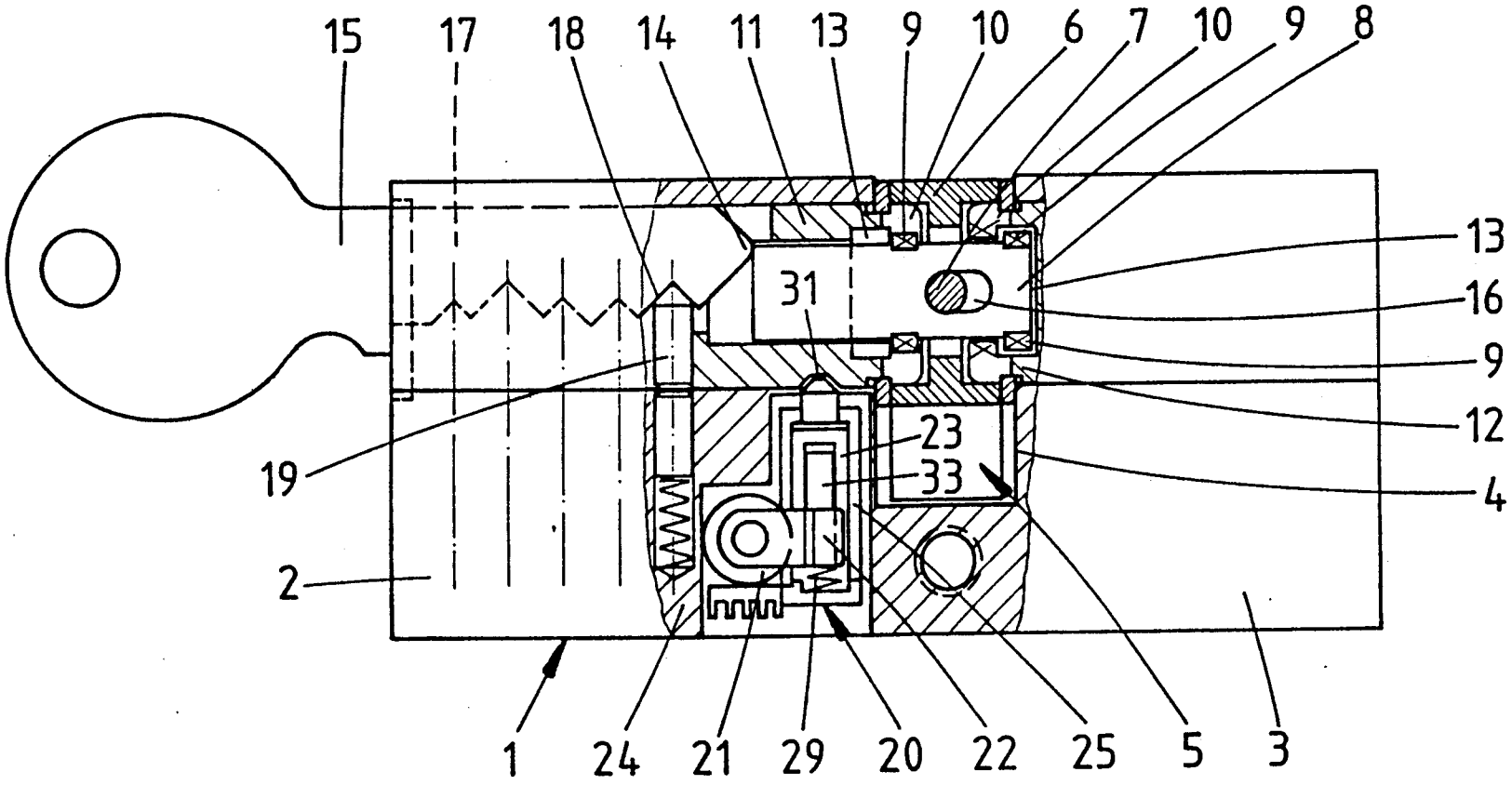
FIG. 1 shows a lock cylinder constructed according to the invention partially in elevation and partially in section.

The lock cylinder 1 illustrated is a double profile cylinder. It comprises the two casing halves 2 and 3 between which there is a cut out 4 for receiving a lock element 5. The hub 6 thereof is transversed by a transverse pin 7 passing through a coupling element 8 which is movable within the hub. Diametrically opposed vanes 9 protrude from the centre and one end thereof and pass between corresponding transverse slits 10 in the cylinder cores 11, 12, depending upon the position of the coupling element. The transverse slits are located in bore portions, the diameter of which is adapted to that of the coupling element 8. Bores 13 are connected to the bore portions and allow the vanes 9 of the coupling element 8 to sink in a freely rotatable manner while the other vanes 9 are positively engaged with the transverse slit 10 of the corresponding cylinder core, depending on the final position of the coupling element 8.

The key tip 14 of a flat key 15 serves to control the coupling element 8. The coupling element 8 is equipped with a slot 16 for the passage of the transverse pin 7 so that it can be moved. As the key shank 17 is inserted into the key channel of the corresponding cylinder core, mechanically operating, spring-loaded tumbler pins 19 are arranged in such a way via its closing notches 18 that the point of separation between the core pins and casing pin lies on the rotation joint of the cylinder core.

As shown in FIG. 1, the casing half 2 facing one side of the door can be longer in construction than the other casing half 3. This provides space for arranging an electromagnetic tumbler 20 between the last tumbler 19 of the housing half 2 and the lock element 5. For length compensation, the coupling element 8 is continued beyond the central vanes 9 so that it can be controlled by the key. The essential components of the magnetic tumbler are a coil 21, a C-shaped armature 22 and an additional tumbler pin 23. The additional tumbler pin 23 is movably, but non-rotatably arranged in the cylinder casing 24, with the interposition of a sleeve 25 of antimagnetic material forming the pin bore 25'. The lower end of the sleeve 25 is sealed by a stopper 26, while the opposite end is shaped into a collar 27. The collar 27 is penetrated by the end 28 of the additional tumbler pin 23 which is offset stepwise. A compression spring 29 resting on the stopper 26 loads the additional tumbler pin 23 in the direction of the cylinder core 11. The tumbler pin head region 30 tapers towards its free end and sinks into an appropriately shaped locking indentation 31 of the cylinder core 11.

In its central region, the additional tumbler pin 23 has a recess 32 lying transverse to the longitudinal central plane of the lock cylinder. A locking member 33 is mounted pivotally therein round a pivot pin 34 extending in the longitudinal direction of the lock cylinder. The cross section of the locking member 33 is such that it does not exceed that of the tumbler pin 23. In a longitudinal bore, the locking member 33 carries a permanent magnet 35 whose magnet poles taper toward their free ends in order to concentrate the magnetic field lines. The magnet poles are opposed by ferromagnetic core pieces 36, 37 arranged on either side of the recess 32 to produce the neutral position of the locking member 33 in the tumbler pin 23. The core piece 37 is a headless screw which centres the compression spring 29 so that optimum adjustment can be carried out.

In the pivoting plane of the locking member 33, the tube 25 has a niche 38 originating from the pin bore 25'. This niche 38 runs parallel to the direction of movement of the tumbler pin 23. The lower transverse wall of the niche 38 begins beneath the locking member 33 and represents a stop 38' which co-operates with a locking edge 39 of the locking member 33 so that the locking member 33 projects with this locking edge beyond the periphery of the additional tumbler pin 23 in the locking position. The locking edge 39 is formed by the transverse flank pointing in the return direction of the tumbler pin. The side of the locking member 33 remote from the locking edge 39 has an arresting edge 40. This arresting edge 40 is located above a step 38" on the cylinder casing when the tumbler pin 23 is in the locking position. This step 38" is formed by the other transverse wall of the niche 38 in the tube 25 which is in turn part of the cylinder casing 24.

Figure 2:
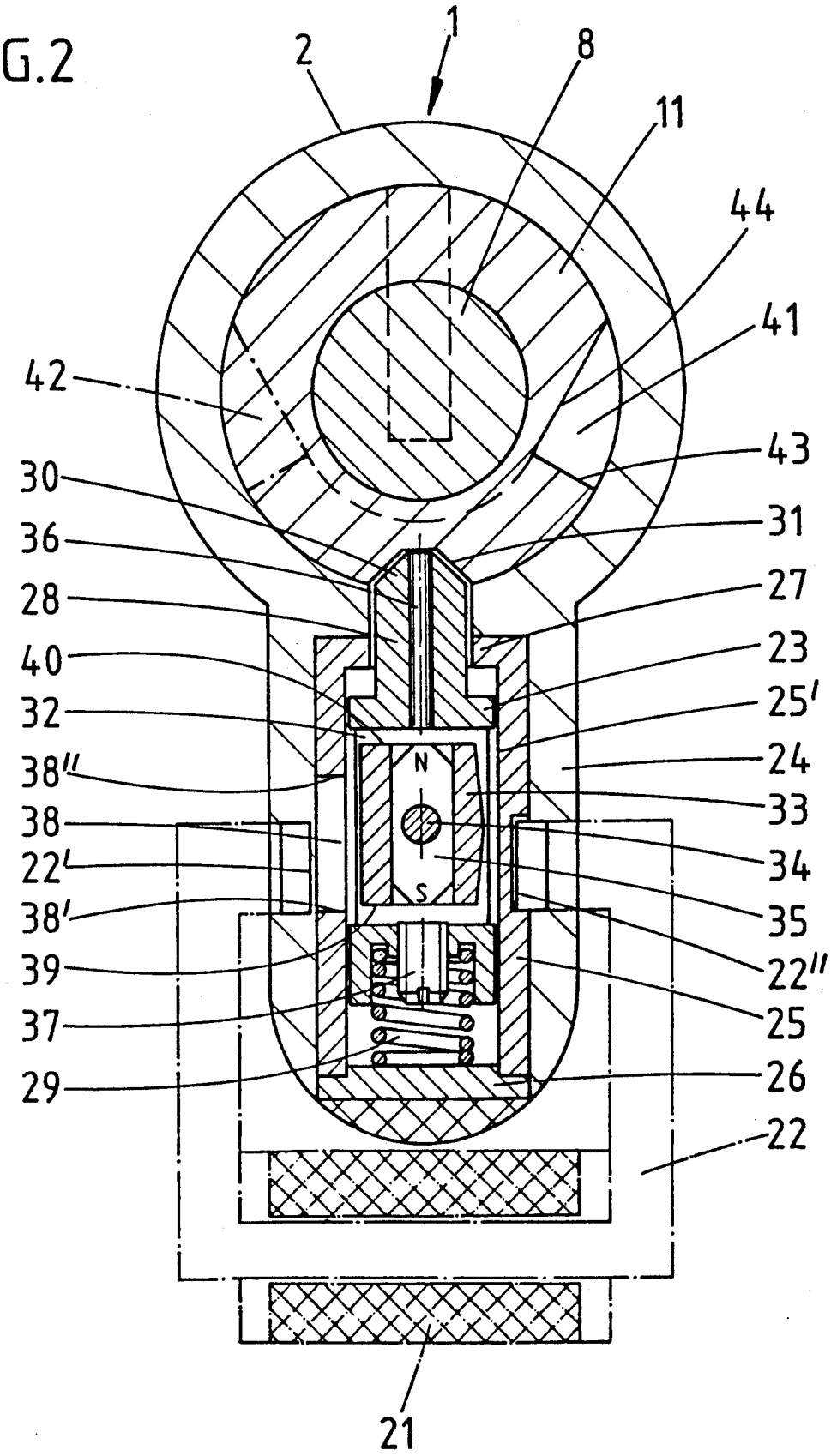
FIG. 2 shows a cross section through the lock cylinder in the region of the additional tumbler pin with a schematically illustrated armature which has a coil and, for clarity, is rotated by 90° from the starting position, that is to say when the key is not introduced.
Figure 3:
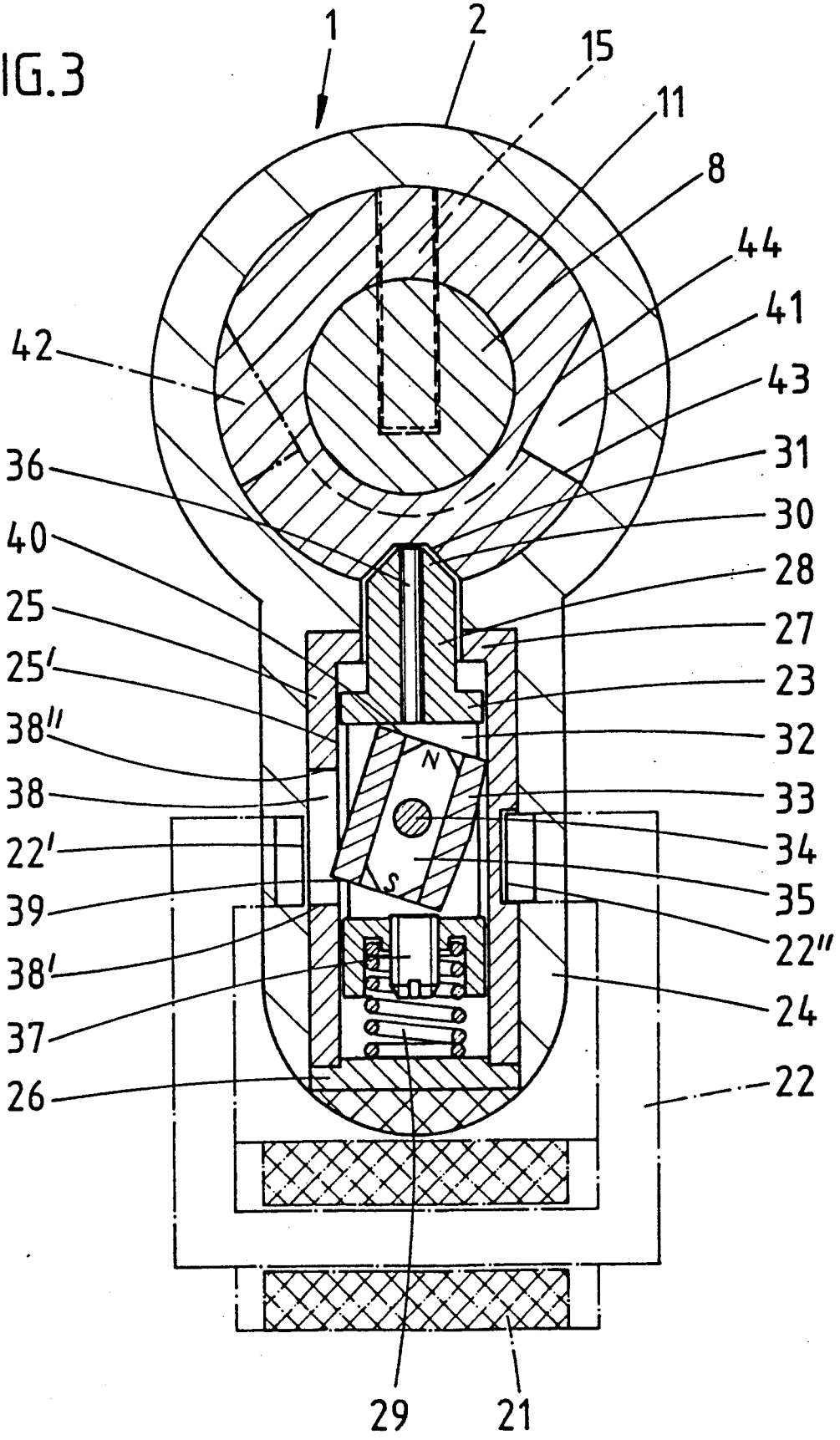
FIG. 3 corresponds to FIG. 2, but with the key inserted and the locking member pivoted into the locking position.
Figure 4:
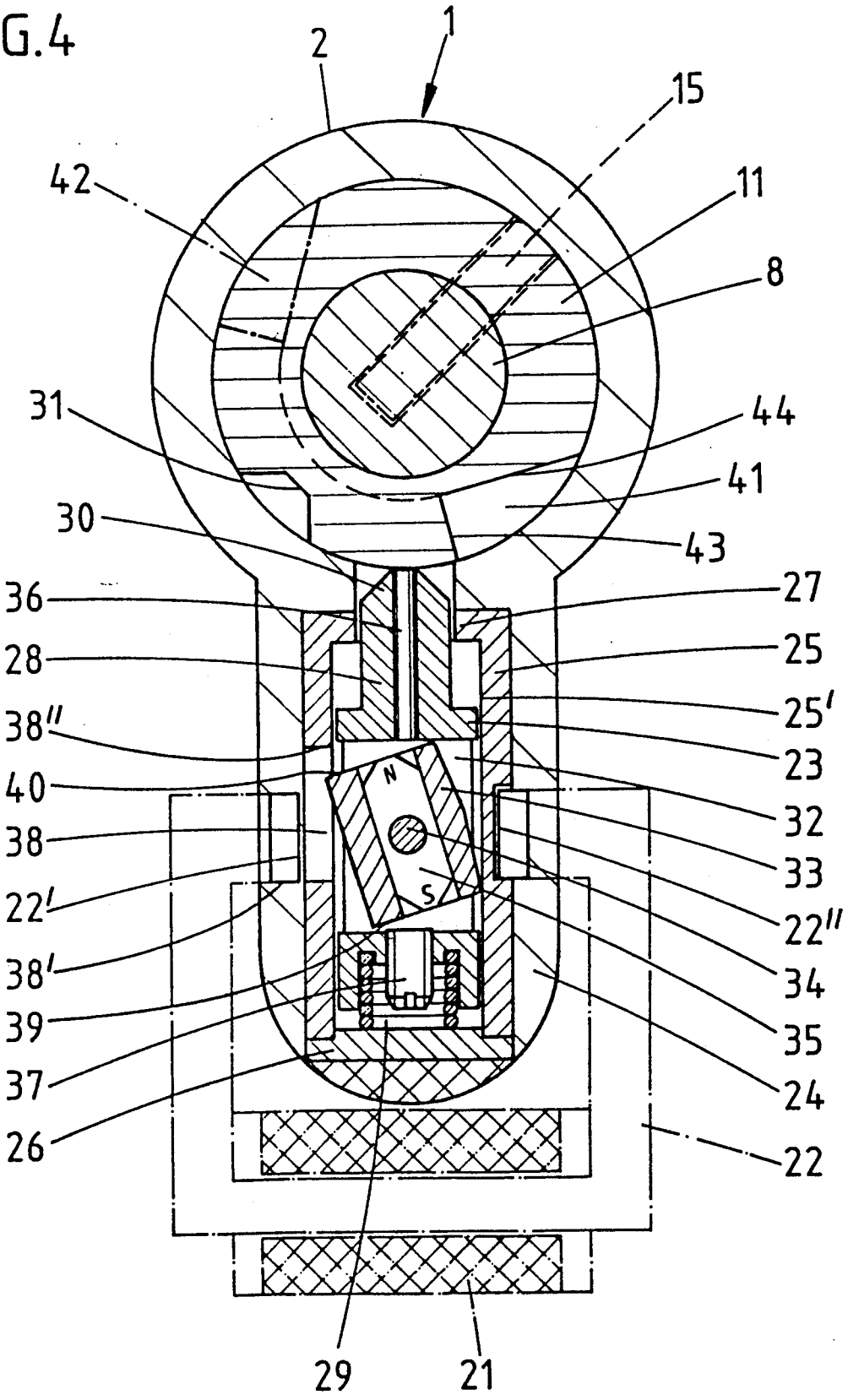
FIG. 4 also shows a cross section through the lock cylinder in an intermediate rotational position in which the locking member pivots before entry of the tumbler pin into the receiving indentation in such a way that the arresting step comes into effect.

As shown in FIGS. 2 to 4, the cylinder core 11 has a receiving indentation 41 drawn in solid lines. However, a second receiving indentation 42 could also be provided. It is shown in dash-dot lines in FIGS. 2 to 4. The two receiving indentations 41, 42 are provided symmetric to the longitudinal central plane of the lock cylinder, based on the key withdrawal position, and are used selectively. The receiving indentation 41 is used if the lock cylinder is installed in right-hand locks. On the other hand, the receiving indentation 42 is used if it is to be installed in left-hand locks.

The receiving indentation 41 or 42 serves to retain the flat key 15 within the key channel in the event of an electric power failure.

Each receiving indentation 41 or 42 has a radially directed rotation limiting shoulder 43 continued by a flank 44 which lies at right angles to it, is orientated chordally and extends to the rotational joint of the cylinder core. The position of the receiving indentation 41 or 42 is offset at such an angle that the cylinder core assumes a rotational position deviating from the key withdrawal position of the cylinder core 11 when the tumbler pin 23 is caught in the receiving indentation. Catching is effected by the rotation limiting shoulder 43 which passes towards the end 28 of the tumbler pin 23 offset stepwise.

According to FIG. 5, a control portion of different design is constructed on the cylinder core 11'. This cylinder core 11' has a receiving indentation 41. However, it lacks a locking indentation for the tumbler pin 23. The locking indentation is replaced by a flattened area 45 in the corresponding region of the cylinder core 11', on which the blunt end 30' of the tumbler pin 23 rests. This design also allows forced escape movement of the tumbler pin 23 as the cylinder core 11' begins to rotate.

The inserted position of the flat key 15 in the cylinder core 11 is detected by a first sensor S1, see circuit diagram in FIG. 6. A second sensor S2 is also provided. When the head 30 of the tumbler pin 23 faces the receiving indentation 41, this second sensor S2 responds in order to move arresting edge 40 of locking member 33 to an arresting position as described hereinafter with respect to selective arresting of the movement of tumbler pin 23.

FIG. 2 shows that the imaginary straight connecting line between the magnet poles of the locking member 33 points in the direction of the longitudinal axis of the tumbler pin in the neutral position of the locking member 33.

The C-shaped armature 22 is oriented horizontally in FIGS 2 to 4. It consequently runs parallel to the longitudinal axis of the lock cylinder and does not exceed the outer contour thereof. The coil 21 is also located inside the lock cylinder casing 24. The armature 22 is so oriented relative to the tumbler pin 23 and locking member 33 that the locking member 33 lies between the pole faces of this C-shaped armature 22. In this embodiment, the lower region of the locking member 33 extends between the pole faces of the armature 22.

The straight connecting line between these armature poles intersects the connecting straight line between the magnet poles, at right angles in the neutral position of the locking member 33.

FIG. 6 shows the circuit installed in the interior of the lock cylinder casing 24. An energy source (battery, accumulator or the like) is provided, the positive pole of which is indicated by 46 and the negative pole by 47 as earth in FIG. 6. One contact 48 of the sensor S1 constructed as a switch is connected to the positive pole 46 while the other terminal 49 leads via a junction 50 and a line 51 to a terminal 52 of the sensor S2 also constructed as a switch. The other terminal 53 of the sensor S2 leads to a junction 54 connected to a relay 55. The other terminal of the relay 55 leads to the negative pole (earth). A line 56 leads from the junction 50 to an electronic evaluator 57 connected to a reading device (not shown) which detects the key code of the key. The output 58 of the electronic evaluator 57 leads to the anode of a diode 59, the cathode of which leads to a collecting point 60.

The junction 50 also leads, by means of the line 56 and a further line 61, to a switch contact 62 of a two-pole changeover switch 63 controlled by the relay 55. The switch contact 62 is also connected via a line 64 to a switch contact 65 of the changeover switch 63. The line 64 also leads to the cathode of a diode 66, the anode of which leads to a distribution point 67. The distribution point 67 is connected to the collector of a transistor 68 whose emitter leads to the negative pole 47. The base of the transistor 68 is connected via a resistor 69 to the collecting point 60. The collecting point 60 is also connected via a resistor 70 whose other terminal leads to the negative pole 47.

From the distribution point 67 a line 71 runs leading to a contact 72 of the changeover switch 63, this contact 72 being associated with the switch contact 65. The line 71 also leads to a contact 73 of the changeover switch 63, this contact 73 being associated with the switch contact 62. The two lug poles 74 and 75 of the two-pole changeover switch 63 lead to the coil 21.

As mentioned, the sensor S1 constructed as a switch is closed as soon as a key is introduced into the key channel of the cylinder core 11. The sensor S2 constructed as a switch closes as soon as the cylinder core 11, 11' comes into a rotational position region in which the head 30 or 30' of the tumbler pin 23 opposes the receiving indentation 41. This rotational position region is indicated by the broken line 76 in FIG. 5 and represents the angular range within which sensor S2 is closed with respect to the rotation of cylinder core 11, 11'. This region—viewed from the periphery of the cylinder core—is preferably somewhat larger than the receiving indentation 41 to allow the closing of the sensor S2 before, during and after movement of the indentation 41 adjacent to the tumbler pin 23 to insure that movement of the pin into the indentation is prevented as described hereinafter. It is noted that broken line 76 is merely representative of an angular range relative to cylinder core 11, 11' and is not intended to indicate another indentation. According to a preferred embodiment (not shown), the sensor S2 constructed as a switch is controlled by means of a cam arranged on the cylinder core 11, 11' and maintains the sensor S2 in the closed condition as the region 76 passes adjacent the sensor S2 upon movement of the cylinder core 11, 11'.

The lock is operated as follows:

The position of the lock cylinder 1 shown in FIG. 2 is the starting point. If the key 15 is now inserted into the key channel of the cylinder core 11, this is detected by the sensor S1—as already described—i.e. the appropriate switch in FIG. 6 closes. The voltage (positive pole 46) of the power supply is switched through to the terminal 52 of the sensor S2, the electronic evaluator 57 is also connected to the positive pole 46 and the two switch contacts 62 and 65 are connected to the positive pole. The contact associated with the sensor S1 closes, independently of whether or not the key 15 has authority to lock, i.e. it is merely necessary for the key to be inserted mechanically into the key channel. This insertion causes the electronic evaluator 57 to emit a signal at its output 58 via the diode 59 and the resistor 69 to the base of the transistor 68, so that this is controlled through causing the negative pole 47 to be connected to the contact 72 and 73 of the changeover switch 63. The coil 21 is consequently connected to the power supply such that its terminal 77 is connected to the positive pole 46 and its terminal 78 to the negative pole 47. This results in the formation of a magnetic field such that a north pole is formed at the pole face 22' and a south pole at the pole face 22" of the C-shaped armature 22. The locking member 33 consequently pivots into the position shown in FIG. 3. This takes place so quickly that rotation of the lock cylinder is not possible. Consequently, the locking edge 39 passes in front of the stop 38', preventing the tumbler pin 23 from escaping. The cylinder core 11 cannot therefore twist from its position shown in FIG. 3.

After introduction of the key 15, the key is interrogated about its electronic authorisation to lock by means of a reading device (not shown). This authorisation to lock is produced, for example by an electronic code which is interrogated, for example, without contact (inductively or capacitively) or by formation of an oscillating circuit of determined frequency or the like. Electronic lock authorisation processes of this type are known in the prior art and consequently are not described in detail here.

If the data coming from the reading device and fed to the electronic evaluator 57 show that the introduced key 15 is authorised to lock, then the base of the transistor 68 is controlled via the output 58 of the electronic evaluator 57 such that the transistor 68 blocks, i.e. the coil 21 is de-energised. Consequently, the locking member 33 automatically passes into the neutral position according to FIG. 2 because of its permanent magnetism. The north and south poles of the permanent magnetic 38 thus oppose the core pieces 36 and 37. In this neutral position of the locking member 33, the periphery thereof is aligned with that of the tumbler pin 23 so that, during twisting of the cylinder core 11, the tumbler pin 23 is driven downwards by the oblique flanks of the locking indentation 31 (cf. FIG. 4). The compression spring 29 is compressed in the process. If the key is not authorised to lock, the base of the transistor 68 is not driven in the above-mentioned sense but, rather, the terminal 77 of the coil 21 remains at the positive pole 46 and the terminal 78 of the coil 21 at the negative pole 47 so that the position of the locking member 33 according to FIG. 3 remains. It is not therefore possible to lock using this key.

With reference to FIG. 4, if the cylinder core 11 is twisted in an attempt to effect locking, the receiving indentation 41 opposes the head 30 or 30' of the tumbler pin 23. As indicated by the line 76 in FIG. 5, the sensor S2 responds in this pivoting angle range—as described before—i.e. the associated switch is closed so that the relay 55 is energised. The changeover switch 63 therefore changes over so that the contact 73 with the lug pole 74 and the switch contact 65 with the lug pole 75 are connected. At the same time, the positive voltage of the positive pole 46 is switched via a diode 79 lying between the junction 54 and the collecting point 60 and via the resistor 69 to the base of the transistor 68 so that the transistor 68 becomes conductive again. Owing to the position of the changeover switch 63 described above, the coil 21 now receives a flow of current in the opposite direction, i.e. the terminal 77 is connected to the negative pole 47 and the terminal 78 to the positive pole 46. This causes a field to build up such that the pole face 22' forms a south pole and the pole face 22" a north pole. The locking member 33 will consequently twist into the position shown in FIG. 4. In this position, the arresting edge 40 is located beneath the step 38" as the tumbler pin 23 is located in its depressed position. Now if the receiving indentation 41 is passed over by the head of the tumbler pin 23, then the tumbler pin 23 is unable to enter in locking fashion as it is held on the step 38" owing to the contact of the arresting edge 40.

However, if the electronic system of the lock fails, possibly due to a fault or to a power failure or owing to exhausted batteries, then the arresting function of the tumbler pin 23 described above does not occur, i.e. the cylinder core 11 is unable to turn back into its key withdrawal position as the tumbler pin 23 is caught in the receiving indentation 41. The user is therefore forced to take appropriate steps to retrieve his key 15. It is therefore always ensured that such faults will be recognised and announced.

When the system is in working order, the position according to FIG. 2, in which the head 30 or 30' passes or enters into the locking indentation 31 or against the flattened area 45 owing to the neutral position of the locking member 33, is again adopted for withdrawing the key.

The lock cylinder 1 is locked from one side of the door in the normal manner used with mechanically operating lock cylinders.

We claim:

1. A lock cylinder suitable for mortise locks with mechanically operating tumbler pins controlled by a key and at least one electromagnetic tumbler which is arranged in a cylinder casing and comprises a coil as well as a locking member which can be displaced by electromagnetic forces for an additional tumbler pin which is in addition to the key-controlled operating tumbler pins and which is spring-loaded in a locking direction and with an electronic evaluator which is responsive to a key code, wherein said locking member is pivotally mounted in a recess in said additional tumbler pins and enters a locking position in front of a stop on said cylinder casing.

2. A lock cylinder according to claim 1, wherein said additional tumbler pin is formed with a periphery and said locking member projects with a locking edge over the periphery of said additional tumbler pin in said locking position.

3. A lock cylinder according to claim 1, which further comprises a member having a bore formed therein for receiving said additional tumbler pin and wherein said stop is formed by a wall of a niche formed through said member to said bore.

4. A lock cylinder according to claim 1, wherein said locking member is carried by a pivot pin running transversely to the longitudinal axis of said tumbler pin.

5. A lock cylinder according to claim 1, wherein said locking member comprises a permanent magnet.

6. A lock cylinder according to claim 5, wherein said permanent magnet includes magnet poles and the magnet poles associated with said permanent magnet taper toward their free ends.

7. A lock cylinder according to claim 6, wherein ferromagnetic core pieces arranged in said additional tumbler pin oppose said magnet poles to produce a neutral position of said locking member.

8. A lock cylinder according to claim 7, wherein at least one of said core pieces is constructed so as to be axially movable.

9. A lock cylinder according to claim 2, wherein said locking edge is formed by an edge of a surface of said locking member.

10. A lock cylinder according to claim 2, which further comprises a cylinder core for receiving said key and wherein a surface of said locking member opposite from said locking edge has an arresting edge which, in an arresting position of said additional tumbler pin, passes against a step on said cylinder casing in such a way that a locking action between said cylinder core and said additional tumbler pin is removed.

11. A lock cylinder according to claim 1, wherein a first sensor (S1) detects an inserted position of said key.

12. A lock cylinder according to claim 1, which further comprises a cylinder core for receiving said key and wherein said additional tumbler pin with a head region thereof sinks into a locking indentation in said cylinder core in a key withdrawal position.

13. A lock cylinder according to claim 5, wherein said permanent magnet includes magnet poles and wherein an imaginary straight connecting line between said magnet poles of said locking member point in the direction of the longitudinal axis of said additional tumbler pin when said locking member is in a neutral position.

14. A lock cylinder according to claim 1, wherein a C-shaped armature includes pole faces between which said locking member is located and which is associated with said coil.

15. A lock cylinder according to claim 14, wherein said locking member is a permanent magnet with magnet poles at opposite ends thereof and wherein a straight connecting line between said pole faces intersects a straight connecting line between said magnet poles.

* * * * *